US010639888B2

(12) United States Patent
Morisue et al.

(10) Patent No.: US 10,639,888 B2
(45) Date of Patent: May 5, 2020

(54) LIQUID EJECTION HEAD

(71) Applicant: CANON KABUSHIKI KAISHA, Tokyo (JP)

(72) Inventors: Masafumi Morisue, Tokyo (JP); Yoshiyuki Nakagawa, Kawasaki (JP); Kazuhiro Yamada, Yokohama (JP); Takuro Yamazaki, Inagi (JP); Ryo Kasai, Tokyo (JP); Tomoko Kudo, Kawasaki (JP); Takashi Sugawara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/134,211

(22) Filed: Sep. 18, 2018

(65) Prior Publication Data

US 2019/0092012 A1 Mar. 28, 2019

(30) Foreign Application Priority Data

Sep. 27, 2017 (JP) ..... 2017-186669

(51) Int. Cl.
*B41J 2/14* (2006.01)

(52) U.S. Cl.
CPC ..... *B41J 2/14201* (2013.01); *B41J 2/1404* (2013.01); *B41J 2202/12* (2013.01)

(58) Field of Classification Search
CPC ... B41J 2/14201; B41J 2/1404; B41J 2202/12
See application file for complete search history.

(56) References Cited

U.S. PATENT DOCUMENTS

| | | | | |
|---|---|---|---|---|
| 9,403,372 | B2 * | 8/2016 | Taff | B41J 2/17596 |
| 2019/0001692 | A1 | 1/2019 | Yamazaki et al. | |
| 2019/0001699 | A1 | 1/2019 | Nakakubo et al. | |
| 2019/0023016 | A1 | 1/2019 | Nakagawa et al. | |
| 2019/0023018 | A1 | 1/2019 | Nakagawa et al. | |

FOREIGN PATENT DOCUMENTS

| | | | |
|---|---|---|---|
| WO | 2013/130039 | A1 | 9/2013 |

OTHER PUBLICATIONS

IP.com search (Year: 2019).*

* cited by examiner

*Primary Examiner* — Lisa Solomon
(74) *Attorney, Agent, or Firm* — Venable LLP

(57) ABSTRACT

A liquid ejection head including a substrate, an energy generating element which is provided on the substrate and is used for ejecting a liquid, a flow passage forming member which includes an ejection orifice, which ejects the liquid, and which forms a flow passage of the liquid between the flow passage forming member and the substrate, and an electrode which is provided on a surface of the flow passage forming member which adjoins the flow passage and which generates a flow of the liquid, in which at least a portion of the electrode is covered within the flow passage forming member.

20 Claims, 7 Drawing Sheets

LIQUID EJECTION HEAD

BACKGROUND OF THE INVENTION

Field of the Invention

The present invention relates to a liquid ejection head.

Description of the Related Art

In a liquid ejection head which ejects a liquid such as an ink, there is a case in which the liquid inside an ejection orifice increases in viscosity due to a volatile component in the liquid evaporating. In a case in which the increase in the viscosity of the liquid is particularly notable, there is a case in which the fluid resistance increases and liquid ejection faults occur. A method in which a fresh liquid which does not have an increased viscosity is allowed to flow inside the ejection orifice is known as one countermeasure for the viscosity increasing phenomenon of the liquid. An example of a method of allowing the liquid to flow is a method using a micro-pump such as alternating current electro-osmosis (ACEO), for example (International Publication No. WO2013/130039).

SUMMARY OF THE INVENTION

A liquid ejection head according to the present invention includes a substrate, an energy generating element which is provided on the substrate and is used for ejecting a liquid, a flow passage forming member which includes an ejection orifice, which ejects the liquid, and which forms a flow passage of the liquid between the flow passage forming member and the substrate, and an electrode which is provided on a surface of the flow passage forming member which adjoins the flow passage and which generate a flow of the liquid, in which at least a portion of the electrode is covered within the flow passage forming member.

Further features of the present invention will become apparent from the following description of exemplary embodiments with reference to the attached drawings.

DESCRIPTION OF THE EMBODIMENTS

Figure 1:
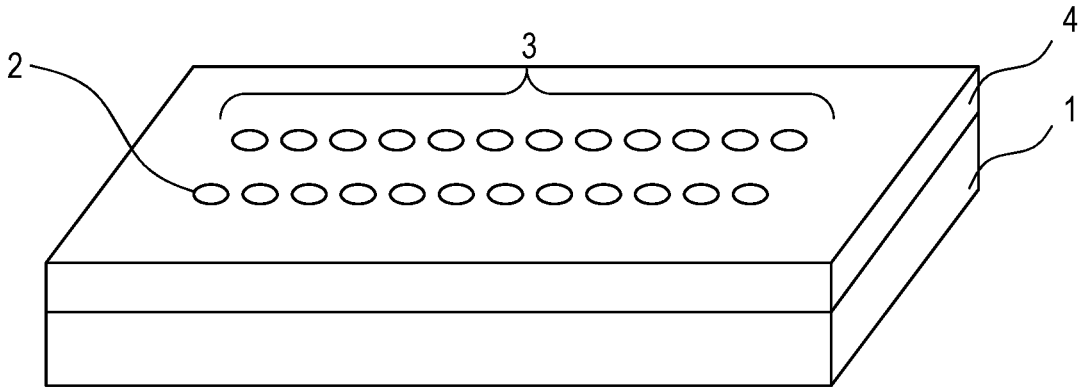
FIG. 1 is a perspective view illustrating an example of a liquid ejection head according to the present invention.

Preferred embodiments of the present invention will now be described in detail in accordance with the accompanying drawings.

In International Publication No. WO2013/130039, electrodes which generate a liquid flow are disposed on a substrate. According to the considerations of the inventors of the present invention, the following problems exist in such electrodes.

Since the liquid flow is generated in the vicinity of the electrode surfaces in the ACEO system, the liquid flow on the substrate side is fast with the disposition of the electrodes described in International Publication No. WO2013/130039. With such an electrode disposition, the efficiency for allowing fresh liquid with a low viscosity to flow into the ejection orifice is low.

A configuration in which the electrodes are disposed on a surface of a flow passage forming member which adjoins the flow passage is conceivable in order to improve the efficiency. In a case in which the electrodes are disposed on the surface of the flow passage forming member, high adherence between the electrodes and the flow passage forming member is demanded. This is because there is a case in which the adhering force is lowered by usage over a long period and peeling and lifting occur in the electrodes. In a case in which the electrodes peel from the flow passage forming member, the electrodes fall into the flow passage, the driving ability of the ACEO is no longer sustainable, the electrodes become a hindrance to the flow of the liquid, and liquid ejection faults and the like occur.

An object of the present invention is to provide a liquid ejection head capable of suppressing the peeling of the electrodes from the flow passage forming member.

The liquid ejection head according to the present invention is provided with a substrate, an energy generating element, a flow passage forming member, and an electrode. The energy generating element is provided on the substrate and is used for ejecting the liquid. The flow passage forming member includes an ejection orifice, which ejects the liquid, and forms the flow passage of the liquid between the substrate and the flow passage forming member. The electrode is provided on the surface of the flow passage forming member which adjoins the flow passage and generates a flow of the liquid. Here, at least a portion of the electrode is covered within the flow passage forming member.

In the liquid ejection head according to the present invention, at least a portion of the electrode is covered in the inner portion of the flow passage forming member. Therefore, the portion of the electrode which is covered within the flow passage forming member is not exposed to the liquid, it is possible to maintain the adherence between the electrode and the flow passage forming member, and it is possible to suppress the peeling of the electrode from the flow passage forming member even in usage over a long period.

Hereinafter, a description will be given of the liquid ejection head according to an embodiment of the present invention with reference to the drawings. Although a specific configuration of an ink jet recording head which is an embodiment of the present invention and ejects an ink as the liquid will be described in each of the following embodiments, the present invention is not limited thereto. It is possible to apply the liquid ejection head according to the present invention to apparatuses such as a printer, a copier, a facsimile device including a communication system, and a word processor including a communication system, and furthermore, it is possible to apply the liquid ejection head to an industrial recording apparatus which is combined in an integrated manner with various processing apparatuses. For example, it is also possible to use the liquid ejection head for purposes such as bio-chip manufacturing and electronic circuit printing. The embodiments which are described below are appropriate specific examples of the present invention, and so various limitations that are technically preferable are applied. However, as long as a configuration aligns with the idea of the present invention, the present embodiment is not limited to the embodiments of the present specification or other specific methods.

First Embodiment

FIG. 1 is a perspective view illustrating an ink jet recording head according to an embodiment of the present invention. A flow passage forming member 4 is bonded onto a substrate 1 and a plurality of ejection orifices 2 is disposed in the flow passage forming member 4. A plurality of the ejection orifices 2 is arranged to form each of a plurality of ejection orifice rows 3. The flow passage forming member 4 may include an organic material such as an epoxy resin from the viewpoint of improving dimensional freedom in the formation of the flow passage forming member 4.

Figure 2A:
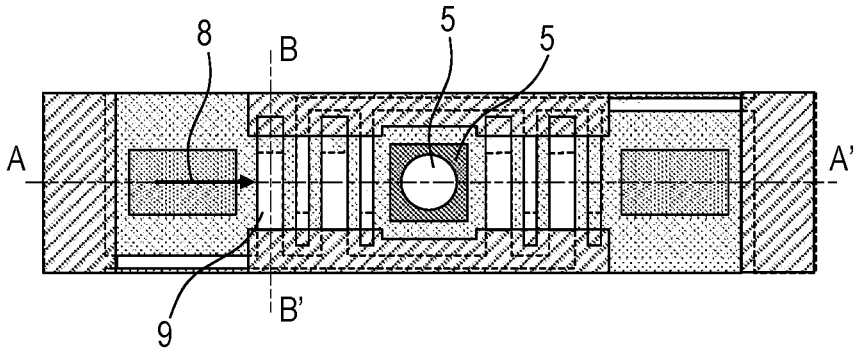
FIGS. 2A, 2B, 2C and 2D are a schematic plan view and schematic sectional diagrams illustrating an example of an embodiment of the present invention.
Figure 2B:
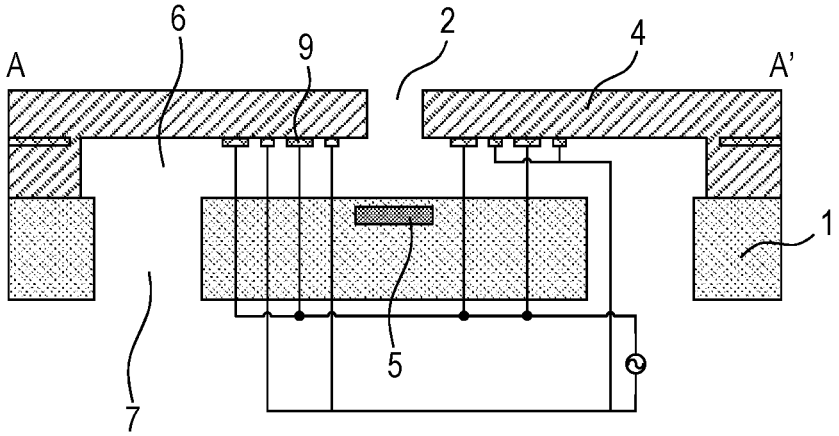
Figure 2C:
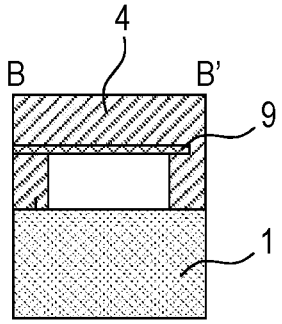
Figure 2D:
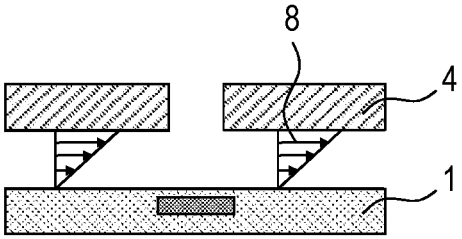

FIG. 2A is a schematic plan view illustrating an ink jet recording head according to the present embodiment. FIG. 2B is a schematic sectional diagram taken along an A-A' line of FIG. 2A. FIG. 2C is a schematic sectional diagram taken along a B-B' line of FIG. 2A. FIG. 2D is a schematic diagram illustrating a flow speed distribution of the ink in FIG. 2B.

As illustrated in FIG. 2B, the substrate 1 includes an energy generating element 5 which generates the energy to eject the ink. In FIG. 2B, the energy generating element 5 is schematically illustrated as being buried in the substrate 1, although the configuration is not limited thereto. For example, there is an energy generating element 5 which is formed of TaSiN on the substrate 1 which is formed of silicon and it is possible to adopt a configuration in which an insulating layer formed of SiN or a protective film formed of Ta is provided on the energy generating element 5. A supply orifice 7 of the ink which penetrates the substrate 1 from one surface to the other surface is provided in the substrate 1. The flow passage forming member 4 is provided on the substrate 1. The flow passage forming member 4 includes ejection orifices 2, each of which is provided at a position facing the corresponding energy generating element 5 and ejects the ink. The flow passage forming member 4 forms flow passages 6 of the ink between the flow passage forming member 4 and the substrate 1. The ink which is supplied to the flow passages 6 from the supply orifices 7 is given energy by the energy generating elements 5 and is discharged from the ejection orifices 2 onto an ink receiving medium such as a recording medium. Each region between one of the energy generating elements 5 and the corresponding ejection orifice 2 is a pressure chamber. The pressure chamber is a chamber which is connected to the corresponding flow passage 6 and is provided with the energy generating element 5 in the inner portion of the pressure chamber.

A plurality of electrodes 9 which generates a flow of the ink in a flow direction 8, which is illustrated by an arrow, using alternating current electro-osmosis faces the substrate 1 and is disposed on the surface of the flow passage forming member 4 which adjoins the flow passages 6. The plurality of electrodes includes first electrodes and second electrodes 9 where one of the first and second electrodes is connected to a + terminal and the other is connected to a − terminal of an AC power source. As illustrated in FIG. 2D, in a case in which the ink is caused to flow by the alternating current electro-osmosis, the flow speed distribution of the ink inside one of the flow passages 6 indicates an asymptotic distribution in which the flow speed on the surface of the flow passage forming member 4 is great and the flow speed approaches zero the closer to the surface of the substrate 1. Therefore, in comparison to a configuration in which the electrodes 9 are disposed on the substrate 1, a configuration in which the electrodes 9 are disposed on the flow passage forming member 4 facilitates the efficient flowing of fresh ink which has a low viscosity into the ejection orifices 2. It is possible to circulate the ink inside the pressure chambers between the pressure chambers and the outside of the pressure chambers using the electrodes 9.

In a case in which the electrodes 9 are disposed on the flow passage forming member 4, as described earlier, the adhering force between the electrodes 9 and the flow passage forming member 4 is reduced by a long period of exposure to the ink and the electrodes 9 may peel from the flow passage forming member 4. However, as illustrated in FIG. 2C, since a portion of the electrodes 9 is covered within the flow passage forming member 4 in the present embodiment, the portion of the electrodes 9 which is covered within the flow passage forming member 4 is not exposed to the ink and it is possible to maintain the adherence between the electrodes 9 and the flow passage forming member 4. Accordingly, it is possible to suppress the peeling of the electrodes 9 from the flow passage forming member 4.

It is preferable that, for each of the electrodes 9, the proportion of the area of the portion of the electrode 9 which is covered within the flow passage forming member 4 to the area of the entirety of the electrode 9 when viewed from the ejection direction of the ink (the liquid) be 0.5% to 30%. The ejection direction of the ink is the direction of FIG. 2A, which is a direction heading from the side facing the surface of the substrate 1 toward the surface of the substrate 1. It is preferable that at least a portion of each of the electrodes 9 be covered within a side wall portion of the flow passage forming member 4.

In particular, in the present embodiment, as illustrated in FIGS. 2A and 2C, the electrodes 9 are provided to cross the flow passage 6 in a direction which is perpendicular to the flow direction 8 of the ink inside the flow passage 6 (hereinafter also referred to as the flow direction 8). In other words, the electrodes 9 are provided to cross the entirety of the flow passage 6 in the direction which is perpendicular to the flow direction 8. Both end portions of the electrodes 9 in the direction which is perpendicular to the flow direction 8 are covered within the flow passage forming member 4. Therefore, even if the adhering force at the interface between the electrodes 9 and the flow passage forming member 4 decreases, since both ends of the electrodes 9 are fixed inside the flow passage forming member 4 without directly contacting the ink, the electrodes 9 will not peel off. Even if, hypothetically, a little lifting occurs in the electrodes 9, the function of the electrodes as an electro-osmosis pump is not lost and it is possible to avoid the ejecting of the ink becoming impossible due to the blocking of the insides of the flow passages.

In the present embodiment, the electrodes 9 are disposed in a ceiling region of the flow passages 6 on the surface of the flow passage forming member 4 which faces the substrate 1 and adjoins the flow passages 6. However, the present embodiment is not limited to this configuration and the electrodes 9 may be disposed in side wall regions of the flow passages 6. The positions at which to dispose the electrodes 9 may be selected, as appropriate, in consideration of the orientation and strength of the flow to be generated. However, from the viewpoint of allowing the fresh ink which has a low viscosity to more efficiently flow into the ejection orifices 2, it is preferable that the electrodes 9 be disposed on the surface of the flow passage forming member 4 which faces the substrate 1 and adjoins the flow passages 6, that is, that the electrodes 9 be disposed in the ceiling region of the flow passages 6.

Second Embodiment

Figure 3A:
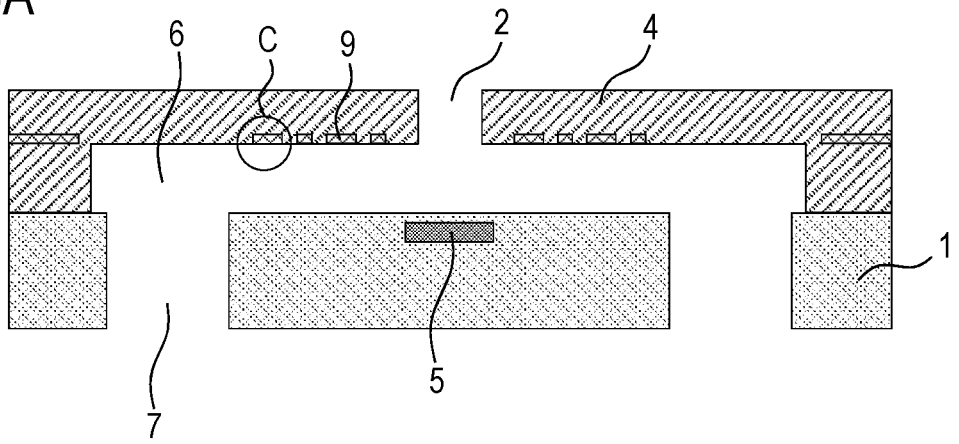
FIGS. 3A, 3B, 3C and 3D are schematic sectional diagrams illustrating an example of an embodiment of the present invention.

FIG. 3A is a schematic sectional diagram illustrating an ink jet recording head according to the present embodiment. In the present embodiment, both end portions of the electrodes 9 in the flow direction of the ink inside the flow passages 6 are covered within the flow passage forming member 4. In other words, the electrodes 9 are installed to be embedded in the flow passage forming member 4. Since the side surfaces of the electrodes 9 are held by the flow passage forming member 4, it is possible to sufficiently suppress the lifting and the peeling of the electrodes 9.

Figure 3B:
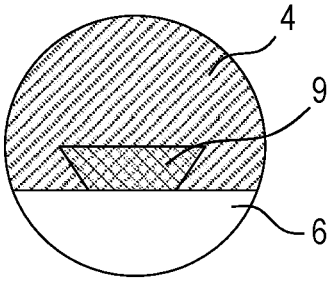
Figure 3C:
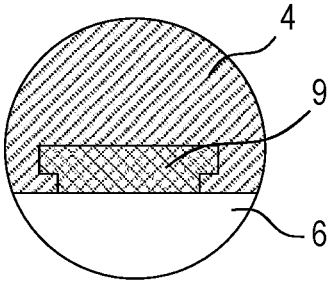

Here, it is preferable that the sectional area of the electrodes 9 on the surface which is substantially horizontal with respect to the substrate 1 decrease in size from the surface which is in contact with the flow passage forming member 4 toward the surface which adjoins the flow passages 6. For example, as illustrated in FIG. 3B which is an enlarged view of a region C which is surrounded by a circle mark in FIG. 3A, the cross-section of each of the electrodes 9 may have a tapered shape and may be a shape which tapers from the surface which is in contact with the flow passage forming member 4 toward the surface which adjoins the corresponding flow passage 6. As illustrated in FIG. 3C, the cross-section of each of the electrodes 9 may have a stepped shape and may be a shape in which the width narrows in a multi-staged manner from the surface which is in contact with the flow passage forming member 4 toward the surface which adjoins the corresponding flow passage 6. By adopting such a sectional shape of the electrodes 9, even if, hypothetically, the adhering force at the interface between the flow passage forming member 4 and the electrodes 9 decreases, the flow passage forming member 4 is capable of physically supporting the electrodes 9 and it is possible to further suppress the peeling of the electrodes 9. A surface which is substantially horizontal with respect to the substrate 1 indicates a surface which is horizontal in a range of ±5° with respect to the surface of the substrate 1.

Figure 3D:
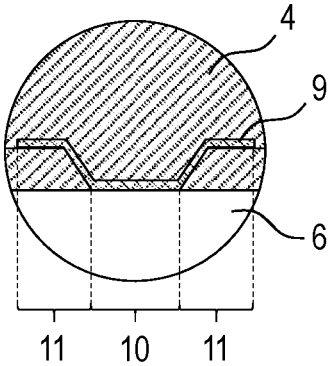

It is preferable that both end portions of the electrodes 9 in the flow direction of the ink inside the flow passages 6 be folded so as to be covered within the flow passage forming member 4. For example, as illustrated in FIG. 3D, each of the electrodes 9 may include a first electrode region 10 which adjoins the ink and second electrode regions 11 which do not adjoin the ink due to the electrode 9 being folded. As illustrated in FIG. 3D, it is preferable that each of the electrodes 9 be disposed substantially horizontally with respect to the substrate 1 in at least a portion of the second electrode regions 11. By adopting such a sectional shape of the electrodes 9, even if, hypothetically, the adhering force at the interface between the flow passage forming member 4 and the electrodes 9 decreases, the flow passage forming member 4 is capable of physically supporting the electrodes 9 and it is possible to further suppress the peeling of the electrodes 9.

Third Embodiment

Figure 4A:
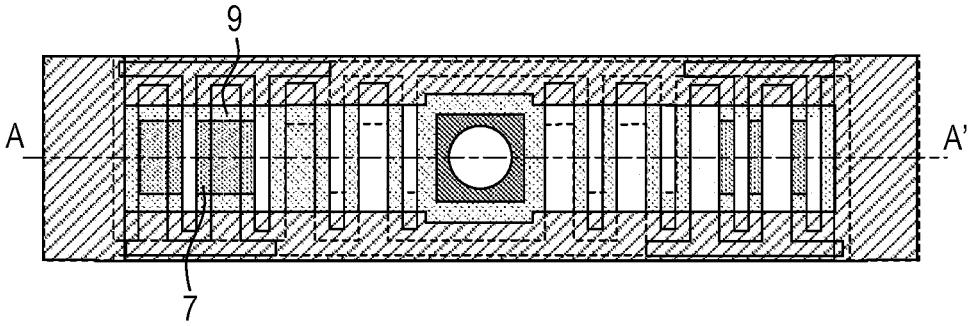
FIGS. 4A and 4B are a schematic plan view and a schematic sectional diagram illustrating an example of an embodiment of the present invention.
Figure 4B:
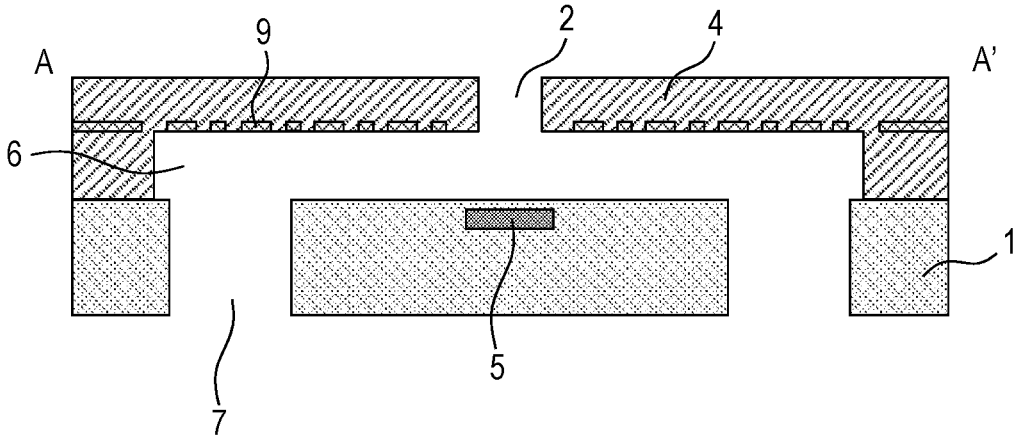

FIG. 4A is a schematic plan view illustrating an ink jet recording head according to the present embodiment. FIG. 4B is a sectional diagram taken along an A-A' line of FIG. 4A. In the present embodiment, the electrodes 9 are provided on the surface of the flow passage forming member 4 which faces the supply orifices 7 of the substrate 1. In the configuration in which the electrodes 9 are disposed on the substrate 1, since it is necessary to dispose each of the electrodes 9 between the corresponding supply orifice 7 and the corresponding energy generating element 5, the disposition region of the electrode 9 is limited and there are difficulties in increasing the number of the electrodes 9. Meanwhile, in the configuration according to the present embodiment, the electrodes 9 are disposed on the surface of the flow passage forming member 4 which adjoins the flow passages 6 and the electrodes 9 are disposed at positions facing the supply orifices 7. Therefore, the disposition region of the electrodes 9 is not limited by the supply orifices 7, it is possible to increase the number of the electrodes 9 without modifying the chip size, and it is possible to strengthen the electro-osmosis pump function.

In the configuration which is illustrated in FIG. 4B, since the electrodes 9 are provided to cross the flow passages 6 in the direction which is perpendicular to the flow direction of the ink inside the flow passages 6, each of the walls of the flow passage forming member 4 is installed between one of the supply orifices 7 and the supply orifice (not illustrated) which is adjacent to the supply orifice 7. In FIG. 4B, although the walls of the flow passage forming member 4 are installed on both sides of one of the supply orifices 7, the present embodiment is not limited thereto and the walls may be installed for a plural number of the supply orifices 7. The installation of the walls may be determined, as appropriate, from the viewpoint of the routing of the wiring of the electrodes 9, the liquid refilling capability, and the like.

Fourth Embodiment

Figure 5A:
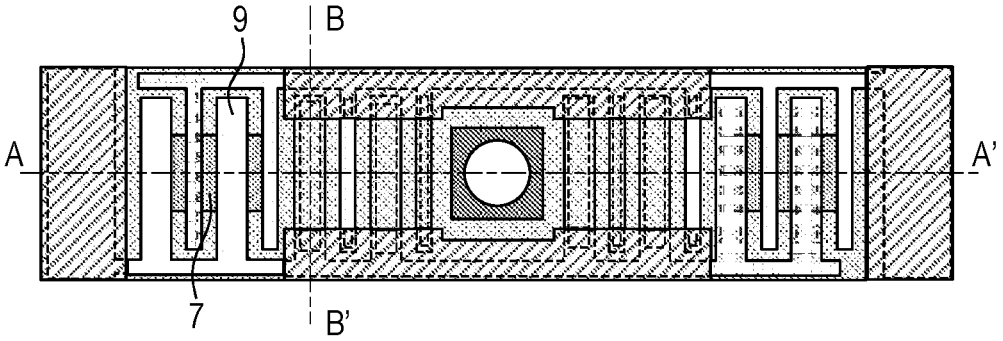
FIGS. 5A, 5B and 5C are a schematic plan view and schematic sectional diagrams illustrating an example of an embodiment of the present invention.
Figure 5B:
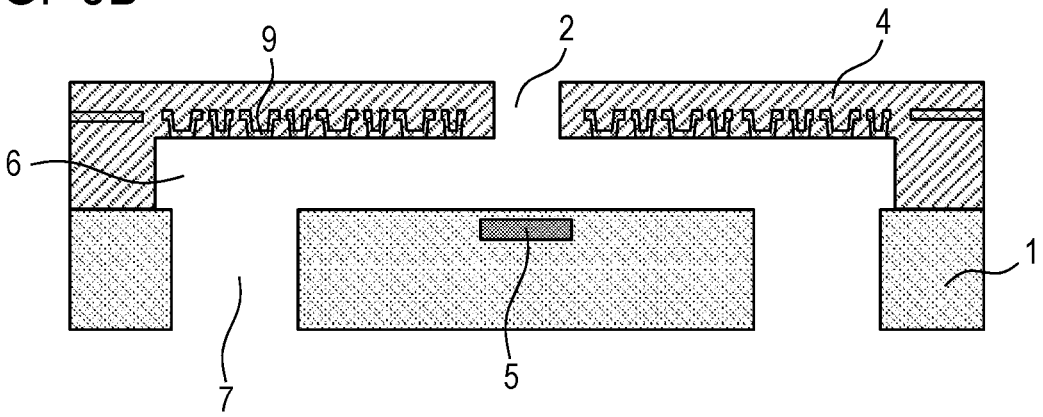
Figure 5C:
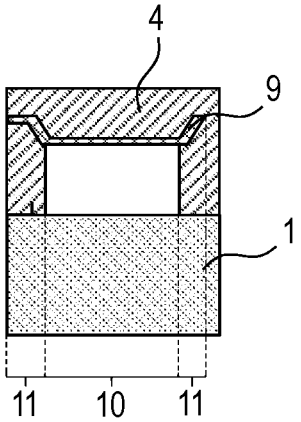

FIG. 5A is a schematic plan view illustrating an ink jet recording head according to the present embodiment. FIG. 5B is a sectional diagram taken along an A-A' line of FIG. 5A. FIG. 5C is a sectional diagram taken along a B-B' line of FIG. 5A. In the present embodiment, in the same manner as in the third embodiment, the electrodes 9 are provided on the surface of the flow passage forming member 4 which faces the supply orifices 7. As illustrated in FIG. 3D which is the second embodiment, each of the electrodes 9 includes the first electrode region 10 which adjoins the ink and the second electrode regions 11 which do not adjoin the ink due to the electrode 9 being folded. In the present embodiment, in comparison to the third embodiment, even in a case in which the electrodes 9 cross the flow passages 6 in the direction which is perpendicular to the flow direction of the ink inside the flow passages 6 at positions facing the supply orifices 7, it is not necessary to install the walls of the flow passage forming member 4 between the supply orifices 7. As illustrated in FIG. 5C, this is because each of the electrodes 9 is held by the flow passage forming member 4 by the second electrode regions 11. Accordingly, it is not necessary to consider the routing of the wiring of the electrodes 9, the liquid refilling capability, and the like, and it becomes possible to dispose the electrodes 9 at the desired positions.

Fifth Embodiment

Figure 6A:
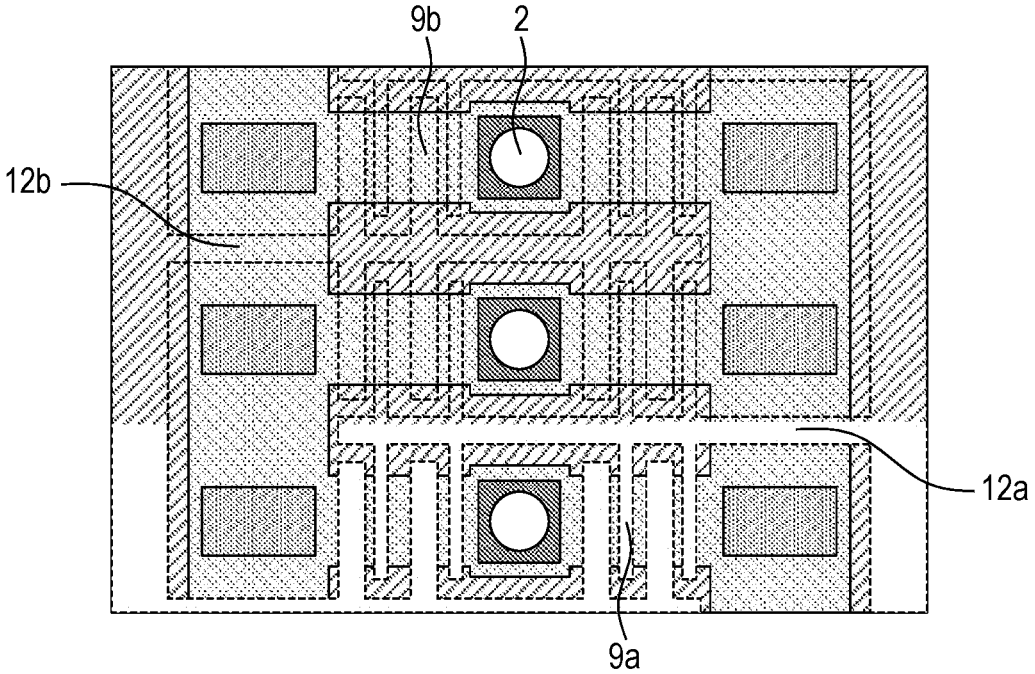
FIGS. 6A and 6B are schematic plan views illustrating an example of an embodiment of the present invention.
Figure 6B:
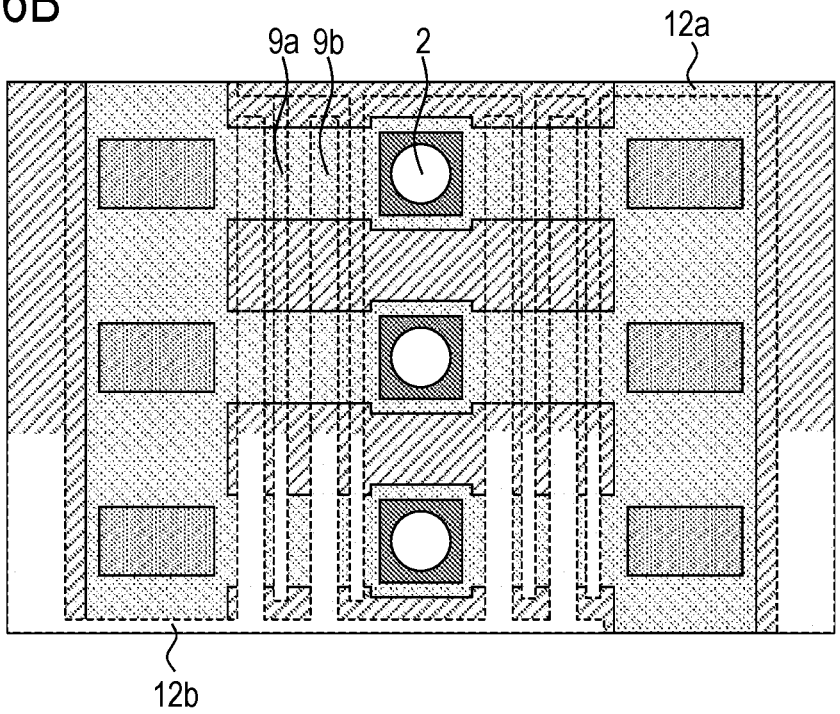

FIGS. 6A and 6B are schematic plan views illustrating an ink jet recording head according to the present embodiment. In the present embodiment, each of the electrodes 9 is provided to cross a plurality of the flow passages 6 which are adjacent to each other. In other words, each of the electrodes 9 is provided continuously to cross the entirety of a plurality of the flow passages 6 which are adjacent to each other in the direction which is perpendicular to the flow direction 8. As described earlier, the electrodes 9 include first electrodes 9*a* and second electrodes 9*b* where one of the first and second electrodes 9*a* and 9*b* is connected to a + terminal and the other is connected to a − terminal of an AC power source, respectively. In order to dispose the electrodes 9 in all of the flow passages 6 corresponding to each of the ejection orifices 2 of an ejection orifice row, a configuration may be adopted in which a wiring 12 which is connected to the + terminal or the − terminal is provided inside the wall of the flow passage forming member 4 which is provided between adjacent ejection orifices 2 and the electrodes 9 are routed from the wiring 12 toward the flow passages 6 on both sides. For example, a first wiring 12*a* which is connected to the first electrode 9*a* and a second wiring 12*b* which is connected to the second electrode 9*b* may be disposed alternately (FIG. 6A), and the wirings may be disposed to skip over a plurality of the ejection orifices 2 (FIG. 6B). In a case in which the wiring 12 is disposed to skip over a plurality of the ejection orifices 2, a configuration is adopted in which the electrodes 9 penetrate the walls of the flow passage forming member 4 to cross the ceilings of a plurality of the flow passages 6. In the configuration according to the present embodiment, since it is possible to reduce the number of distal end portions of the electrodes 9 which serve as starting points for the peeling, it is possible to further suppress the peeling of the electrodes 9 from the flow passage forming member 4 and the reliability of the ink jet recording head is further improved. The number of the flow passages 6 to be crossed by each of the electrodes 9 may be selected, as appropriate, in consideration of the power supply capability or the like.

Sixth Embodiment

Figure 7A:
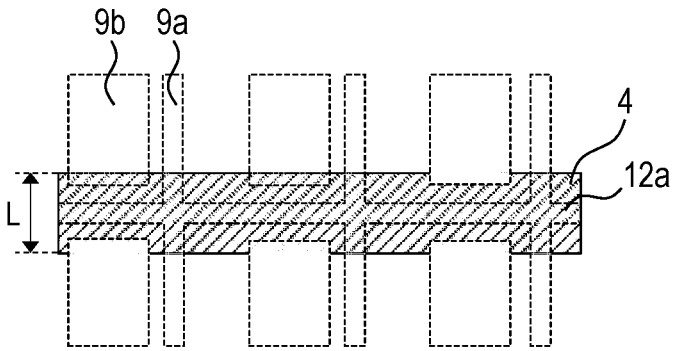
FIGS. 7A, 7B, 7C and 7D are schematic plan views and a schematic sectional diagram illustrating an example of an embodiment of the present invention.
Figure 7B:
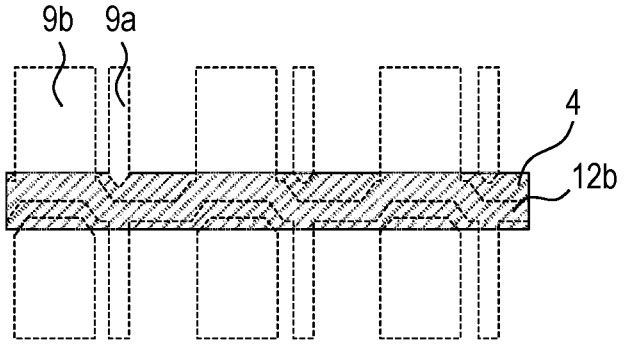
Figure 7C:
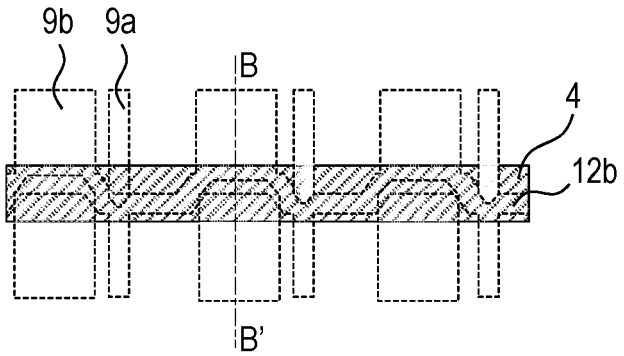
Figure 7D:
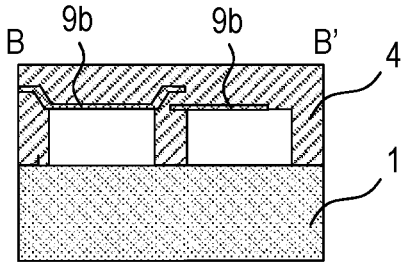

FIG. 7A is a schematic plan view in which a wall of the flow passage forming member 4 which is provided between adjacent ejection orifices 2, and the first electrodes 9*a*, the second electrodes 9*b*, and the first wiring 12*a* which are disposed inside the wall are excerpted from the ink jet recording head which is illustrated in FIG. 6A. FIGS. 7B and 7C are schematic plan views illustrating an ink jet recording head according to the present embodiment, and in the same manner as FIG. 7A, are views in which a wall of the flow passage forming member 4, and the first electrode 9*a*, the second electrode 9*b*, and the second wiring 12*b* which are disposed inside the wall are excerpted. FIG. 7D is a schematic sectional diagram taken along a B-B' line of FIG. 7C.

In FIG. 7A, the leading end portion of the second electrode 9*b* is covered within the flow passage forming member 4. Since the leading end portion of the second electrode 9*b* being covered within the flow passage forming member 4 by greater than or equal to 1 μm in the direction which is perpendicular to the flow direction of the ink inside the flow passage 6 enables sufficient suppression of the peeling and falling off of the distal end portion of the second electrode 9*b* from the flow passage forming member 4, this configuration is preferable. The same applies to the case of the first electrode 9*a* being covered within the flow passage forming member 4. Since the first electrode 9*a* and the second electrode 9*b* are not to have electrical continuity, it is necessary to provide a space between the first electrode 9*a* and the second electrode 9*b*. It is preferable that the first electrode 9*a* and the second electrode 9*b* be disposed to be separated from each other by greater than or equal to 2 μm. A width L of the wall of the flow passage forming member 4 may be selected, as appropriate, in consideration of an overlapping region between the leading end portion of each of the electrodes 9 and the wall of the flow passage forming member 4, the space between each of the electrodes 9, the width of the wiring 12, and the like. However, since an increase in the width L of the wall of the flow passage forming member 4 widens the interval between the ejection orifices 2, it is preferable that the width L of the wall of the flow passage forming member 4 be reduced from a viewpoint of increasing the density of the ejection orifices 2.

The configuration illustrated in FIG. 7B, for example, is an example of a configuration which reduces the width L of the walls of the flow passage forming member 4. In this configuration, the electrodes 9 include the plurality of first electrodes 9*a* and the plurality of second electrodes 9*b*, and a position at which each of the first electrodes 9*a* is covered within the flow passage forming member 4 and a position at which each of the second electrodes 9*b* is routed from the second wiring 12*b* inside the flow passage forming member 4 to one of the flow passages 6 are disposed on a straight line. Since the routing position of each of the electrodes 9 from the wiring 12 and the leading end position of each of the electrodes 9 which is covered within the flow passage forming member 4 are disposed on the same straight line, it is possible to reduce the overlapping region between the electrodes 9 and the flow passage forming member 4 and the space between the electrodes 9 in comparison to the configuration illustrated in FIG. 7A. Therefore, it is possible to reduce the width L of the walls of the flow passage forming member 4. As illustrated in FIG. 7B, since chamfering the corners of each of the electrodes 9 enables each of the electrodes 9 to be disposed as in this configuration while maintaining the width of the wiring 12, the chamfering is preferable.

The configuration illustrated in FIGS. 7C and 7D is an example of another configuration which reduces the width L of the walls of the flow passage forming member 4. In this configuration, as illustrated in FIG. 7C, the electrodes 9 (the second electrodes 9*b*) are disposed so as to overlap each other inside the flow passage forming member 4 as viewed from the ejection direction of the ink. As illustrated in FIG. 7D, the electrodes 9 (the second electrodes 9*b*) are separated from each other. Since the second electrodes 9*b* overlap each other as viewed from the ejection direction of the ink while being separated in the height direction to interpose the flow passage forming member 4, it is possible to reduce the width L of the walls of the flow passage forming member 4 in comparison to the configuration illustrated in FIG. 7A. For example, as illustrated in FIG. 7D, by folding a portion of each of the electrodes 9 as in the fourth embodiment, it is possible to dispose the electrodes such that the electrodes overlap each other as viewed from the ejection direction of the ink while being separated from each other in the height direction to interpose the flow passage forming member 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186669, filed Sep. 27, 2017, which is hereby incorporated by reference herein in its entirety.

What is claimed is:

1. A liquid ejection head comprising:

a substrate comprising an energy generating element which is used for ejecting a liquid;

a flow passage forming member to be joined to the substrate, and which includes a cavity which forms a flow passage of the liquid between the flow passage forming member and the substrate, and an ejection orifice through which the liquid is ejected and which is disposed at a region opposed to the energy generating element; and an electrode which generates a flow of the liquid in the flow passage, wherein the electrode is disposed in a ceiling region of the flow passage forming member which faces the substrate and at least a portion of the electrode is embedded within the flow passage forming member.

2. The liquid ejection head according to claim 1, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

3. The liquid ejection head according to claim 1, wherein the electrode is provided to cross the flow passage in a direction which is perpendicular to a flow direction of the liquid inside the flow passage.

4. The liquid ejection head according to claim 3, wherein the electrode crosses a plurality of the flow passages which are adjacent to each other.

5. The liquid ejection head according to claim 4, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

6. The liquid ejection head according to claim 3, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

7. The liquid ejection head according to claim 1, wherein both end portions of the electrode in a direction which is perpendicular to a flow direction of the liquid inside the flow passage are embedded within the flow passage forming member.

8. The liquid ejection head according to claim 7, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and an outside of the pressure chamber.

9. The liquid ejection head according to claim 1, wherein both end portions of the electrode in a flow direction of the liquid inside the flow passage are embedded within the flow passage forming member.

10. The liquid ejection head according to claim 9, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

11. The liquid ejection head according to claim 9, wherein a cross-sectional area of the electrode in a plane which is substantially parallel to a surface of the substrate decreases in size from a surface of the electrode which is in contact with the flow passage forming member toward a surface of the electrode which adjoins the flow passage.

12. The liquid ejection head according to claim 11, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

13. The liquid ejection head according to claim 9, wherein both end portions of the electrode in the flow direction of the liquid inside the flow passage are folded to be embedded within the flow passage forming member.

14. The liquid ejection head according to claim 13, wherein the substrate comprises a first opening for introducing the liquid into the flow passage and a second opening for removing the liquid from the flow passage through a pressure chamber corresponding to the energy generating element and the ejection orifice, and the liquid is circulated between the pressure chamber and outside of the pressure chamber.

15. The liquid ejection head according to claim 2, wherein the ceiling region of the flow passage member where the electrode is disposed includes regions facing the first opening and the second opening and regions facing a flow region between the first opening and the second opening.

16. The liquid ejection head according to claim 1, wherein the electrode includes a plurality of first electrodes and a plurality of second electrodes, and wherein a position at which each of the first electrodes is embedded within the flow passage forming member and a position at which each of the second electrodes is routed from wiring inside the flow passage forming member to the flow passage are disposed on a straight line.

17. The liquid ejection head according to claim 1, wherein two adjacent flow passages are formed between the flow passage forming member and the substrate, and the electrode includes a folded electrode associated with one flow passage and a planar electrode associated with the other flow passage, the folded electrode has two ends in a transverse direction perpendicular to the flow direction of the liquid, the two ends being folded relative to a main portion of the folded electrode and being embedded in the flow passage forming member, one end of the planar electrode in the transverse direction is embedded in the flow passage forming member, embedded portions of the folded electrode and the planar electrode overlap when viewed in a liquid ejection direction so as to define planar overlapped portions, and when viewed in the flow direction, the planar overlapped portions are separated from each other in the liquid ejection direction.

18. The liquid ejection head according to claim 1, wherein the flow passage forming member includes an organic material.

19. The liquid ejection head according to claim 1, wherein a proportion of an area of a portion of the electrode which is embedded within the flow passage forming member to an area of the entirety of the electrode when viewed along an ejection direction of the liquid is 0.5% to 30%.

20. The liquid ejection head according to claim 2, wherein the ceiling region of the flow passage member where the electrode is disposed is opposed to a flow passage region between the first opening and the second opening.

* * * * *